US006571997B2

(12) United States Patent
Dedrick

(10) Patent No.: US 6,571,997 B2
(45) Date of Patent: Jun. 3, 2003

(54) POUCH ASSEMBLY

(76) Inventor: Ted R. Dedrick, 14135 Campo Rd., Jamul, CA (US) 91935

( * ) Notice: Subject to any disclaimer, the term of this patent is extended or adjusted under 35 U.S.C. 154(b) by 100 days.

(21) Appl. No.: 09/976,584

(22) Filed: Oct. 15, 2001

(65) Prior Publication Data

US 2003/0071095 A1 Apr. 17, 2003

(51) Int. Cl.[7] ..... A45F 5/00
(52) U.S. Cl. ..... 224/183; 224/666; 224/681
(58) Field of Search ..... 224/183, 242, 224/245, 269, 666, 677, 681, 904; 43/54.1, 57.1; 206/338, 349, 350, 372, 373, 818; 383/95

(56) References Cited

U.S. PATENT DOCUMENTS 3,158,300 A * 11/1964 Withee ..... 224/677
3,361,312 A * 1/1968 Hutchison ..... 224/677
3,978,902 A * 9/1976 Adkison ..... 383/11
4,826,059 A * 5/1989 Bosch et al. ..... 224/677
4,928,823 A * 5/1990 Campbell ..... 224/681
4,940,250 A * 7/1990 Corrado ..... 206/818
5,181,637 A * 1/1993 Santilli ..... 224/666
5,259,541 A * 11/1993 Reese ..... 224/677
5,758,807 A * 6/1998 Wright ..... 224/183

* cited by examiner

*Primary Examiner*—Gary E. Elkins
(74) *Attorney, Agent, or Firm*—Charles C. Logan, II

(57) ABSTRACT

A pouch assembly having a pocket member secured to the front wall of a vertically oriented rear panel assembly. The rear panel assembly has a chamber formed in its top half within which is positioned a magnet having a flat front surface. This magnet is adjacent the top end of the pouch member. The magnet functions to hold a limited number of metal fasteners or a metal tool against the front surface of the rear panel assembly where they can be easily grasped by a person wearing the pouch assembly. A vertically oriented non-collapsible rigid tubular member is secured to the front wall of the rear panel assembly inside the pouch member for removably receiving a writing instrument. A spring clip member is secured to the rear wall of the rear panel assembly for detachably securing the pouch assembly on a person's belt or in the top end of a person's pocket.

14 Claims, 1 Drawing Sheet

POUCH ASSEMBLY

BACKGROUND OF THE INVENTION

The invention relates to a container and more specifically to a pouch assembly that can be worn on a person's belt or clipped on to the top edge of a person's pocket. Presently there are reoccurring occasions when a person is either assembling a structure or disassembling a structure and they need to have easy access to a pouch containing fasteners such as nails, screws, etc. Presently while working most people will periodically take a few fasteners out of a container that is placed near the work area. As they need more fasteners, they have to go back to the supply container and get a refill. There are also times when a person is working while on a ladder assembling or disassembling a structure. They again have the problem of where to store the fasteners they are working with such as in their pockets or holding them in their mouth. These are inconvenient and time inefficient methods of working on a project. Another problem that workers have is lack of a convenient storage place for a pencil.

It is an object of the invention to provide a novel pouch assembly that can be worn on a person's belt or clipped over the top edge of a person's pocket.

It is also an object of the invention to provide a novel pouch assembly that allows small metal fasteners such as nails, screws, bolts etc. to be conveniently held adjacent the upper front surface of the rear panel assembly for easy access.

It is another object of the invention to provide a novel pouch assembly that has a vertically oriented rigid non-collapsible tubular member secured to the rear panel assembly inside the pocket member for removably receiving a writing instrument.

It is an additional object of the invention to provide a novel pouch assembly that is economical to manufacture and market.

It is a further object of the invention to provide a novel pouch assembly whose pocket member has sufficient rigidity to keep it from collapsing during normal use.

SUMMARY OF THE INVENTION

The novel pouch assembly has two major components, a rear panel assembly and a pocket member that is secured to its front surface. The pocket member preferably has a height greater than 50% of the height of the rear panel assembly. The top end of the pocket member is adjacent a magnet that is positioned between the front wall and the rear wall of the rear panel assembly. The front wall is made of a hard smooth plastic material that allows fasteners such as screws, nails and etc. to be easily dragged on and off the magnet. A vertically oriented rigid non-collapsible tubular member is secured to the rear panel assembly inside the pocket member for removably receiving a writing instrument. The pocket member is preferably made of an inner layer and an outer layer of plastic fabric material that gives it sufficient body to keep it from collapsing during normal use. A spring clip member is secured to the rear surface of the rear panel assembly so that the pouch assembly can be worn on a person's belt or clipped over the top edge of a person's pocket.

The pouch assembly when worn, allows a person to reach into the pouch member and drag a few nails up onto the magnet and then pick one or two off as needed. Another occasion when it is quite useful is when disassembling a light fixture while on a ladder. The pouch assembly allows the storing of the screws on the magnet while also having easy access to them when they are needed. Another use is when a wrench is placed in a stand-up position in the pouch member with the top end of the wrench stuck to the magnet which allows it to be easily accessed. Additionally, when using a cordless drill, the magnet in the rear panel assembly provides a convenient staging area for a drill bit and a driver when they need to be used in an alternating manner.

The pouch assembly can also be used independently as a fastener holder. The screws or nails can be shaken on to the magnet for convenience or just stored in the pouch and taken out one at a time. The smooth surface of the wall member covering the magnet allows the fasteners to be dragged on and off the magnet without the necessity of picking them up and placing them on the magnet.

DESCRIPTION OF THE PREFERRED EMBODIMENT

Figure 1:
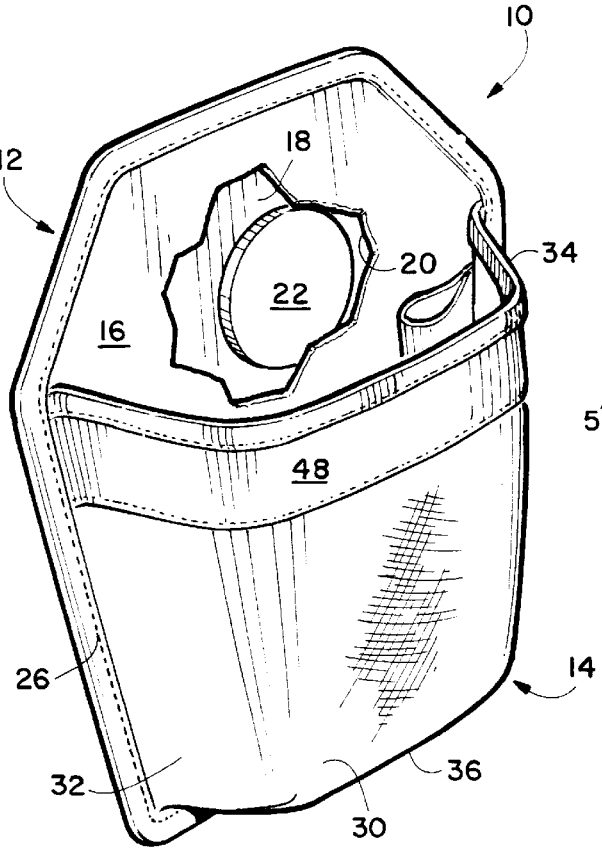
FIG. 1 is a front perspective view of the novel pouch assembly.
Figure 2:
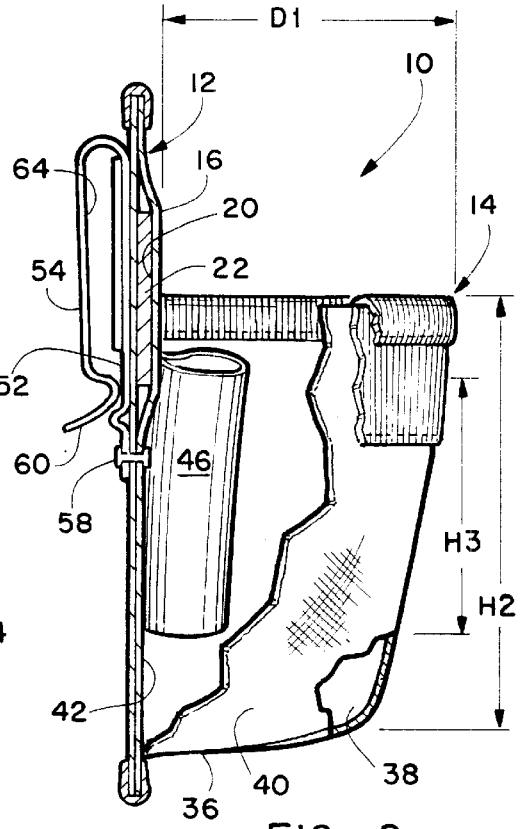
FIG. 2 is side elevation view with portions shown in vertical cross section and portions broken away.
Figure 3:
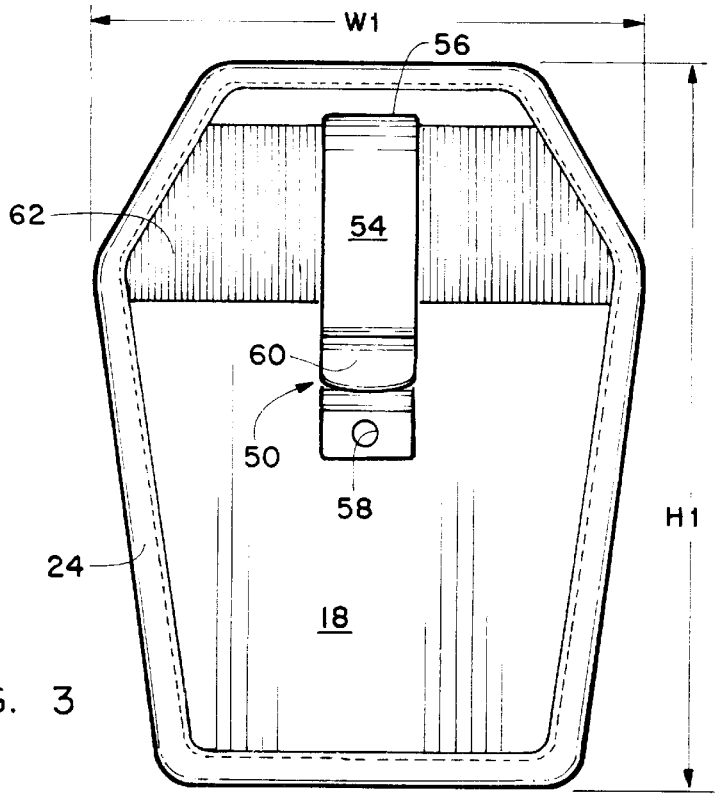
FIG. 3 is a rear elevation view of the novel pouch assembly.

The novel pouch assembly will now be described by referring to FIGS. 1–3 of the drawing. The pouch assembly is generally designated numeral 10. Its major basic components are rear panel assembly 12 and pouch member 14.

Rear panel assembly 12 is formed from a front wall 16 and a rear wall 18 made of a smooth hard plastic material or any other suitable material. A chamber 20 is formed between front wall 16 and rear wall 18 in the upper half of rear panel assembly 12. One or more magnets 22 having a flat front wall surface are positioned in chamber 20. Rear panel assembly 12 has a height H1 in the range of 4–12 inches. A binding trim 24 extends around the perimeter of the rear panel assembly 12 and its stitched thread 26 secures binding trim 24, front wall 16 and rear wall 18 together.

Pouch member 10 has a front wall 30, a left side wall 32, a right side wall 34 and a bottom wall 36. It is formed of an inner layer 38 and an outer layer 40. The left side edge of left side wall 32, the right side edge of right side wall 34 and the front edge of bottom wall 36 are secured to the rear panel assembly 12 by stitched threads 26. Pouch member 14 has a chamber 42 for receiving an assortment of items such as nails, screws, etc. A rigid non-collapsible tubular member 46 is secured to rear panel assembly 12 by the stitched thread 26. An abrasion resistant strip 48 is stitched to the top end of pocket member 14 from its left edge to its right edge. Pocket member 14 has a substantially U-shaped horizontal cross section. Pouch member 14 has a height H2 in the range of 3.5–9 inches. It has a depth D1 in the range of 1.5–6 inches. It has a width W1 in the range of 3.5–9 inches. Tubular member 46 has a height H3 in the range of 1.5–5 inches. Inner layer 38, outer layer 40 and abrasion resistant strip 48 would be preferably made of woven plastic fabric.

Spring clip member 50 has an elongated front leg 52, an elongated rear leg 54, and a U-shaped connecting portion 56. The bottom end of front panel assembly 12 by a rivet 58. A finger portion 60 extends downwardly and outwardly from the bottom end of rear leg 54. A retainer strap 62 extends through the opening 64 of spring clip member 50 and has its opposite ends secured by stitched threads to the rear wall 18 of rear panel assembly 12. Spring clip member 50 is designed to loop around a person's belt or to clip onto the top edge of a person's pocket.

What is claimed is:

1. A pouch assembly comprising a vertically oriented rear panel assembly having a height H1, a width W1, a depth D1, a left edge, a right edge, a top edge, a bottom edge, a front wall and a rear wall; a chamber is formed between said front wall and said rear wall at a predetermined position and at least one magnet is located in said chamber;

said at least one magnet having a front surface and a rear surface;

a vertically oriented pocket member having a front wall, a left side wall, a right side wall and a bottom wall; said front wall, said left side wall and said right side wall are all substantially vertically oriented; said left side wall having a vertically oriented left edge that is secured to said rear panel assembly; said right side wall having a vertically oriented edge that is secured to said rear panel assembly; said bottom wall having a rear edge that is secured to said rear panel; and support means for reversibly securing said pouch assembly to a person using said pouch assembly.

2. A pouch assembly as recited in claim 1 wherein H1 is in the range of 4–12 inches.

3. A pouch assembly as recited in claim 1 wherein W1 is in the range of 3.5–9 inches.

4. A pouch assembly as recited in claim 1 wherein D1 is in the range of 1.5–6 inches.

5. A pouch assembly as recited in claim 1 wherein said pocket is secured to said rear panel assembly by stitched thread.

6. A pouch assembly as recited in claim 1 wherein said pouch is formed from an outer layer of fabric material and an inner layer of fabric material.

7. A pouch assembly as recited in claim 1 wherein said support means comprises a spring clip.

8. A pouch assembly as recited in claim 7 wherein said spring clip has an elongated front leg having a top end and a bottom end, a rear leg having a top end and a bottom end, a U-shaped connecting portion having spaced ends that are connected to said respective top ends of said front leg and said rear leg.

9. A pouch assembly as recited in claim 8 wherein said bottom end of said front leg of said spring clip is attached to the rear panel assembly by a rivet.

10. A pouch assembly as recited in claim 9 further comprising a finger portion formed on said bottom end of said front leg of said spring clip, said finger portion extending downwardly and outwardly from said rear wall of said rear panel assembly.

11. A pouch assembly as recited in claim 1 wherein a horizontal cross section of said pouch is substantially U-shaped.

12. A pouch assembly as recited in claim 1 wherein said pouch has a height H2 and H2 is greater than 0.5 H1 and less than H1.

13. A pouch assembly as recited in claim 1 further comprising a vertically oriented rigid non-collapsible tubular member secured to said front wall of said rear panel assembly for removably receiving a writing instrument.

14. A pouch assembly as recited in claim 1 wherein said front wall of said at least one magnet has a substantially flat surface.

* * * * *